US008311458B2

(12) United States Patent
Tanaka

(10) Patent No.: US 8,311,458 B2
(45) Date of Patent: Nov. 13, 2012

(54) IMAGE FORMING APPARATUS HAVING MECHANISM FOR PREVENTING MIXING OF SCATTERED TONER BETWEEN ADJACENT DEVELOPING UNITS

(75) Inventor: Akinori Tanaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 351 days.

(21) Appl. No.: 12/412,278

(22) Filed: Mar. 26, 2009

(65) Prior Publication Data

US 2009/0245872 A1 Oct. 1, 2009

(30) Foreign Application Priority Data

Mar. 27, 2008 (JP) ..... 2008-084107

(51) Int. Cl.
*G03G 15/01* (2006.01)

(52) U.S. Cl. ..... 399/227

(58) Field of Classification Search ..... 399/227
See application file for complete search history.

(56) References Cited

U.S. PATENT DOCUMENTS

| | | | | |
|---|---|---|---|---|
| 5,471,292 | A * | 11/1995 | Okazawa | 399/233 |
| 6,201,939 | B1 * | 3/2001 | Yamamoto et al. | 399/99 |
| 2004/0013958 | A1 * | 1/2004 | Ayaki et al. | 430/45 |
| 2005/0244192 | A1 * | 11/2005 | Tanaka | 399/227 |
| 2006/0140651 | A1 * | 6/2006 | Hirobe et al. | 399/27 |
| 2006/0198662 | A1 * | 9/2006 | Fukuda et al. | 399/257 |
| 2007/0172260 | A1 | 7/2007 | Fukuda et al. | |

FOREIGN PATENT DOCUMENTS

| | | |
|---|---|---|
| JP | 2002-236392 A | 8/2002 |
| JP | 2006-251717 | 9/2006 |

* cited by examiner

*Primary Examiner* — Walter L Lindsay, Jr.
*Assistant Examiner* — David Bolduc
(74) *Attorney, Agent, or Firm* — Canon USA Inc IP Division

(57) ABSTRACT

In an image forming apparatus having a developing rotary, when a positive direction refers to a circumferential direction of the developing rotary in which the portion of the developing rotary facing a photosensitive drum moves in the same direction as the movement of the circumference of the photosensitive drum, a clear developing unit is farther from the developing unit positioned in the negative direction relative to the clear developing unit than from the developing unit positioned in the positive direction relative to the clear developing unit.

3 Claims, 8 Drawing Sheets

IMAGE FORMING APPARATUS HAVING MECHANISM FOR PREVENTING MIXING OF SCATTERED TONER BETWEEN ADJACENT DEVELOPING UNITS

BACKGROUND OF THE INVENTION

1. Field of the Invention

The present invention relates to image forming apparatuses that form visible images by electrophotography, such as copiers, printers, recorded image display apparatuses, and facsimile machines.

2. Description of the Related Art

Electrophotographic image forming apparatuses are widely used for copiers, multifunction devices having a printing function, and facsimile machines. In recent years, electrophotographic full-color image forming apparatuses have become very popular.

As color image reproduction with full-color image forming apparatuses becomes popular, improvement in color reproduction range and improvement in image quality by reducing graininess have been desired.

From a different point of view, a printing method has been becoming popular in recent years, with which an image is provided with a photographic finish by adding a gloss coating over the entire image or a new expression different from color is produced by changing the gloss of the image.

In order to realize such expression with an electrophotographic image forming apparatus, image forming methods using clear toner have been proposed, among others.

For example, Japanese Patent Laid-Open No. 2006-251717 describes a structure including four color developing units for forming toner images in four respective colors and a developing unit for forming a clear toner image. The document also describes a structure (tandem structure) in which a plurality of image forming units each including a photo conductor and a corresponding developing unit are arranged in a direction in which an intermediate transfer member moves. The document also describes a structure (rotary structure) in which a photo conductor is disposed and a plurality of developing units are moved to a developing position. The rotary structure is superior to the tandem structure in that a smaller image forming apparatus can be easily made.

However, the rotary structure has the following problem. For example, when a developing unit performs developing, air movement is generated by rotation of the image bearing member. The air movement is in the rotation direction of the image bearing member. The air movement causes toner to be scattered from the developing sleeve in the rotation direction of the image bearing member. Therefore, among the developing units adjacent to the developing position, a developing unit in the scattering direction of the toner is liable to color mixing because the scattered toner may enter the developing unit.

In particular, a developing unit using clear toner is more sensitive to toner mixing than development units using color toner. That is because, when color toner is mixed in clear toner, the color toner is very conspicuous even if the amount of the color toner is very small.

The same is true for white toner as in clear toner. Moreover, the same is true for light toner, when dark and light toner with the same hue and different brightnesses are used.

SUMMARY OF THE INVENTION

The present invention is directed to an image forming apparatus including a rotary member that holds developing units including a clear developing unit, in which scattered toner can be prevented from entering the clear developing unit from adjacent developing units with a simple structure.

According to an aspect of the present invention, an image forming apparatus includes an image bearing member on which an electrostatic image is to be formed; a plurality of first developing units each having a first developer bearing member that bears developer including color toner, each of the first developing units configured to develop an electrostatic image that has been formed on the image bearing member at a developing position; a second developing unit having a second developer bearing member that bears developer including toner for forming transparent image, the second developing unit configured to develop an electrostatic image that has been formed on the image bearing member at the developing position; a rotary member that holds the first developing units and the second developing unit, the rotary member configured to rotate so that the first developing units and the second developing unit are moved to the developing position; and a driving unit configured to rotate the rotary member, wherein, when a circumferential direction of the rotary member opposite to a rotation direction of the image bearing member is a positive direction, the second developing unit is held such that a distance between the second developer bearing member and a developer bearing member of a developing unit adjacent to the second developing unit in a negative direction is longer than the distance between the second developer bearing member and a developer bearing member of a developing unit adjacent to the second developing unit in the positive direction.

Further features of the present invention will become apparent from the following description of exemplary embodiments with reference to the attached drawings.

DESCRIPTION OF THE EMBODIMENTS

Hereinafter, an embodiment of the present invention is described in detail with reference to the drawings.

Figure 1:
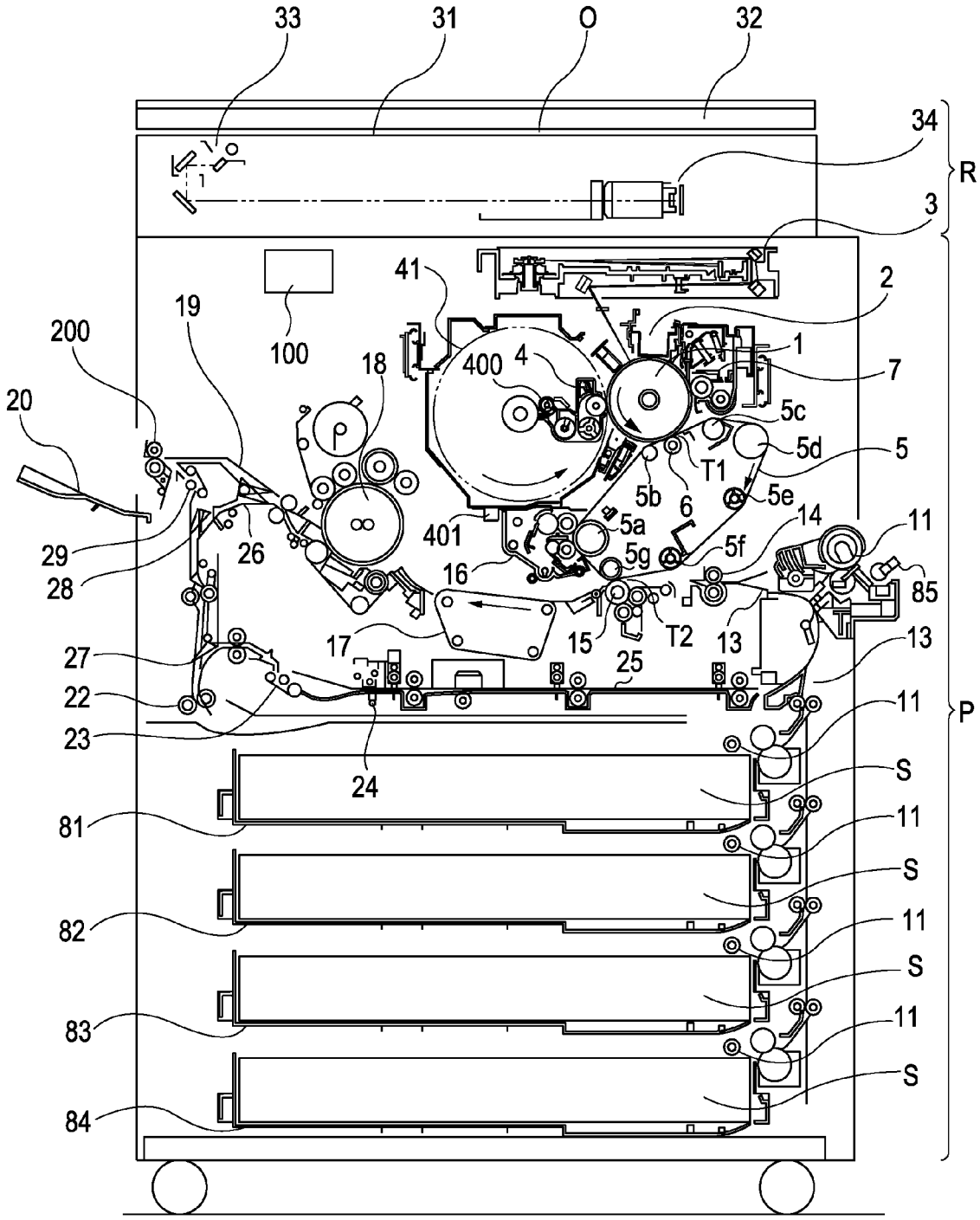
FIG. 1 is a sectional view of an image forming apparatus according to an embodiment.

FIG. 1 is a schematic view of an image forming apparatus according to an embodiment of the present invention. This image forming apparatus is an electrophotographic full-color image forming apparatus. The image forming apparatus includes a digital color image reader section R in the upper part and a digital color image printer section P in the lower part.

The image reader section R includes a glass 31 on which a document is to be placed and a document pressing plate 32.

The document pressing plate 32 can be opened and closed relative to the glass 31. A color document O is placed face down on the glass 31 in accordance with a specified placement mark. The document pressing plate 32 is closed so as to set the document O.

An auto document feeder (ADF, RDF) can be used instead of the document pressing plate 32 so that document sheets are automatically fed onto the glass 31.

A movable optical system 33 moves parallel to the lower surface of the glass 31. The movable optical system 33 optically scans the image surface of the document O facing downward and placed on the glass 31. Light from the scanned document is focused on a CCD 34, which is a photoelectric conversion element (solid-state image pickup element). The light is divided into three primary colors of RGB (red, green, and blue) so as to be read.

The RGB signals that have been read are input to an image processing unit (not shown). A printer section P is an electrophotographic image forming mechanism. The printer section P includes a drum, a rotary developing structure, and an intermediate transfer structure.

An outline of operation of the printer section P is as follows.

A laser scanner 3 forms a light exposure image from an image signal on an electrophotographic photosensitive drum 1 (hereinafter referred to as a photosensitive drum 1). The photosensitive drum 1 corresponds to an image bearing member.

Developing units disposed in a developing rotary successively form toner images in their respective colors on the light exposure image that has been formed on the photosensitive drum. The developing rotary contains a supply pipe 400 for supplying toner (developer) in a desired color as necessary from a toner cartridge (not shown) containing toner in the desired color.

The toner images in respective colors that have been formed on the photosensitive drum 1 are primarily transferred onto an intermediate transfer belt 5 (hereinafter referred to as the belt 5) color by color so that unfused toner images of necessary colors are composed on the belt 5. Then, the toner images are simultaneously secondarily transferred onto a recording sheet S, and fused so that a full-color image product is output.

Hereinafter, the embodiment is described further in detail.

The photosensitive drum 1 rotates at a specified speed in the counterclockwise direction shown by an arrow. A charger 2 uniformly charges the surface of the photosensitive drum 1 to a specified polarity and potential. The charger 2 corresponds to a charging unit. The laser scanner 3 scans and exposes the charged surface. The laser scanner 3 corresponds to a light exposure unit.

The laser scanner 3 includes a laser output unit, a polygon mirror, a focusing lens, and a folding mirror. The laser scanner 3 scans and exposes the charged surface of the rotating photosensitive drum 1 to laser light (optical signals), which is modulated in accordance with image data signals input from an image processing unit (not shown). Thus, an electrostatic latent image corresponding to an exposed pattern is formed on the photosensitive drum 1.

The image data signals may be composed of image data electrically transferred from an external device such as a personal computer as well as image data that is read with the above-described reader section R.

A rotary developing device 4 develops the electrostatic latent image into a toner image.

Figure 2:
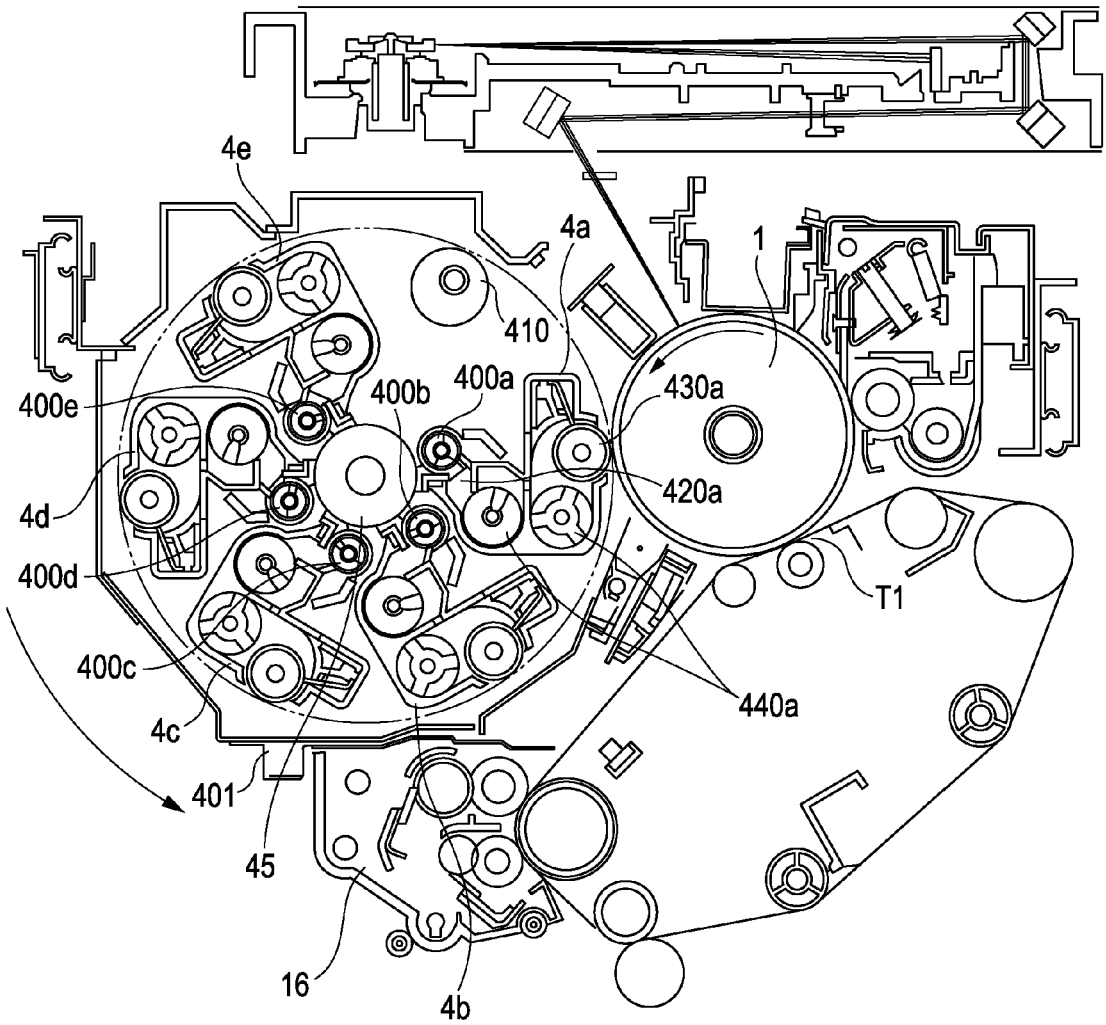
FIG. 2 is a detail sectional view of a developing rotary in the embodiment.

As shown in FIG. 2, the rotary developing device 4 includes a rotary 41 that corresponds to a rotary member. The rotary 41 holds developing units 4*a* to 4*e*. The developing units 4*b* to 4*e* contain color developer including toner in different colors, and the developing unit 4*a* contains clear developer. The developing units held by the rotary 41 can revolve and change their positions. The color developer includes color toner that is nonmagnetic and carrier that is magnetic. The clear developer includes clear toner that is nonmagnetic and carrier that is magnetic.

The rotary 41 is rotated by a specified angle in the direction of an arrow shown in FIG. 2 with specified control timing so that the position of a developing unit is switched to a developing position facing the photosensitive drum 1. In the developing position, the distance between the photosensitive drum 1 and a developing sleeve in the developing unit (SD distance) is maintained in a specified range.

The belt 5 is a flexible endless belt made of a dielectric material. The belt 5 is looped over rollers 5*a* to 5*g*. The outer surface of the belt 5 contacts the photosensitive drum 1 at a contact portion between the rollers 5*b* and 5*c*. The contact portion is referred to as a primary transfer nip T1.

A primary transfer roller 6 is disposed on a side of the belt 5 opposite the photosensitive drum 1. The primary transfer roller 6 contacts the inner surface of the belt 5 at the primary transfer nip T1.

A primary transfer voltage of a polarity opposite the polarity of the toner is applied to the primary transfer roller 6 with specified control timing. The belt 5 is rotated in the clockwise direction shown by an arrow at about the same speed as the photosensitive drum 1, driven by, for example, the roller 5*a*.

First, a toner image in a first color is formed on the photosensitive drum 1 by the above-described image forming process including charging, light exposure, and developing. Then, the toner image is transferred onto the belt 5 at the primary transfer nip T1.

Toner that has not been transferred onto the belt 5 remains on the photosensitive drum 1 as primary transfer residual toner. A drum cleaning unit 7 removes the primary transfer residual toner from the photosensitive drum. After being cleaned by the drum cleaning unit 7, the photosensitive drum 1 is repeatedly used to form an image.

Image forming processes similar to the above are repeated as necessary for a second color to an N-th color. Thus, toner images in respective colors are successively transferred onto the belt 5 in a superimposing manner so that unfused toner images are composed on the belt 5.

First to fourth paper feed cassettes 81 to 84 and a multi manual feed tray 85 are feeders each including a feed roller 11. One of the feed rollers 11 in a preselected feeder is driven at specified control timing. Thus, a recording sheet S contained in the feeder is separated and fed through a sheet path 13 to a registration roller 14.

The registration roller 14 corrects oblique feeding of the recording sheet S and controls the timing with which the toner image is secondarily transferred from the belt 5 onto the recording sheet S. The registration roller 14 receives the leading edge of the recording sheet S that has been fed from the feeder and temporarily stops the recording sheet S.

A secondary transfer roller 15 is a roller counter to the roller 5*g*, which is one of the rollers 5*a* to 5*g* over which the belt 5 is looped. The secondary transfer roller 15 is disposed so as to face the roller 5*g* with the belt 5 therebetween. The secondary transfer roller 15 is controlled so as to be switched between a first state and a second state with a pressure control mechanism (not shown). In the first state, the secondary transfer roller 15 is pressed against the roller 5*g* with a specified pressure. In the second state, the secondary transfer roller 15 is separated from the outer surface of the belt 5.

The secondary transfer roller 15 is normally switched to be in the second state and separated from the outer surface of the belt 5. When the secondary transfer roller is switched to the first state, a secondary transfer nip T2 is formed between the secondary transfer roller 15 and the outer surface of the belt 5.

The secondary transfer roller 15 is switched to the first state at specified control timing. The recording sheet S, which has been temporarily stopped at the registration roller 14, is restarted with the registration roller 14 at specified control timing, and introduced into the secondary transfer nip T2 between the belt 5 and the secondary transfer roller 15 that has been switched to the first state.

The recording sheet S is conveyed through the secondary transfer nip T2. During that time, a secondary transfer voltage of a specified amount is applied to the secondary transfer roller 15 so that the toner images in multiple colors on the belt 5 are simultaneously electrostatically transferred onto the recording sheet S and the unfused toner images are formed (transferred) on the recording sheet S.

Toner that has not been transferred onto the recording sheet S remains on the belt 5 as secondary transfer residual toner. The secondary transfer residual toner is removed from the belt 5 with a belt cleaning unit 16. After being cleaned by the belt cleaning unit 16, the belt 5 is repeatedly used to form an image.

The belt cleaning unit 16 is normally held in a state in which the belt cleaning unit 16 is separated from the outer surface of the belt 5. When the toner image is secondarily transferred from the belt 5 onto the recording sheet S at the secondary transfer nip T2, the belt cleaning unit 16 is switched at specified control timing to a state in which the belt cleaning unit 16 contacts the outer surface of the belt 5.

The recording sheet S exiting the secondary transfer nip T2 is separated from the surface of the belt 5 and conveyed on a conveyer belt unit 17 to a fusing unit 18. At the fusing unit 18, the unfused toner images are fused on the recording sheet S with heat and pressure so as to form a fused image. The recording sheet S exits the fusing unit 18, passes through a sheet path 19, and is output onto a sheet output tray 20.

When there is an additional image to be transferred onto the recording sheet S, the recording sheet S passes through a sheet conveying path 25. The sheet conveying path 25 serves to reconvey the recording sheet S from the fusing unit 18 to the secondary transfer nip T2 when double-side image forming mode or multiple-image forming mode is selected. In the double-side image forming mode, the recording sheet S having an image formed on one side is conveyed after being reversed. In the multiple-image forming mode, the recording sheet S having an image formed by a first process is conveyed without being reversed.

Next, the double-side image forming mode is described below in detail.

A switching flapper 26 guides the sheet exiting the fusing unit 18 to a conveying path shown in the lower part of FIG. 1. A reverse roller 22 reverses the direction in which the sheet is being conveyed so that the trailing edge becomes the leading edge and vice versa. With a switching flapper 27, the sheet is conveyed toward the right side of the figure. A decurler 23 corrects curl of the sheet. A lateral register detection sensor 24 detects the position of the sheet in the main scanning direction (depth direction). The sheet is conveyed to the sheet conveying path 25.

The decurler 23 corrects curl of the sheet in such a way that the sheet is curled downward (convex upward) when the sheet is reconveyed to the secondary transfer nip T2. This is because, if the sheet is curled upward (convex downward), an error in secondary transfer (image failure) may be caused. The error may be caused when, for example, the leading edge of the sheet is caught at the entrance of the nip, the sheet cannot smoothly enter the nip, the sheet is not smoothly conveyed, or the sheet bounces considerably when the sheet enters or exits the nip.

The position of the sheet edge is detected with the lateral register detection sensor 24. The position data is used to adjust a printing position of the image on the back surface of the sheet in the main scanning direction. In this way, even if the position of the sheet in the main scanning direction is changed while the sheet is being conveyed in the double-side conveying path, an image is formed in the position in the main scanning direction that is the same as the position of the image that has been formed on a first surface.

Then, the sheet S again passes through the fusing unit and the sheet path 19. The sheet S is output with a paper output roller 200 onto the sheet output tray 20.

A decurler 29 is disposed in a conveying path that is used to reverse and output the sheet. The decurler 29 serves to provide a downward curl to the sheet that is output onto the sheet output tray. To be specific, the sheet is reversed by the reverse roller 22, conveyed upward in the figure without switching the switching flapper 27, redirected to the paper output roller with a switching flapper 28, and output onto the sheet output tray with a downward curl formed thereon. The sheet is output with a downward curl so that sheets are stacked neatly on the sheet output tray.

In order to secure excellent image stability, the image forming apparatus includes the developing unit 4 having a maximal volume within constraints from the switching speed, the driving torque, and the space capacity of the developing rotary 41 (rotary member).

Therefore, a toner cartridge (not shown) is disposed outside the developing rotary 41, while the developing rotary 41 contains the supply pipe 400 for receiving toner and conveying the toner to the developing units.

The belt cleaning unit 16 is disposed near the bottom of the developing rotary 41. The distance between a sill plate 401 on the bottom of the developing rotary and the locus of the developing sleeve (the circumference shown by a double-dotted chain line in the rotary portion in FIG. 1), which is the outermost periphery of the developing rotary 41, is about 6 mm.

The distance is set to be 6 mm so that the sill plate 401, which is made of metal, does not affect (interfere with) the magnetic pole of the developing sleeve.

As heretofore described, the developing unit has a maximal volume, and the developing rotary has a structure that allows images of respective colors to be developed at the same position from light exposure. Such structures realize excellent stability in density or the like of an image.

Hereinafter, measures against occurrence of toner color mixing in the developing rotary of the image forming apparatus of the embodiment are described in detail with reference to the detailed drawings.

FIG. 2 is a detailed sectional view of a region surrounding the developing units and the developing rotary in the image forming apparatus according to the embodiment of the present invention.

The developing unit 4*a* contains developer including clear toner. A supply pipe (supply path) 400*a* supplies the clear toner.

Likewise, the developing units 4*b*, 4*c*, 4*d*, and 4*e* contain yellow, magenta, cyan, and black developer, respectively. Likewise, supply pipes (supply paths) 400*b*, 400*c*, 400*d*, and 400*e* supply the yellow, magenta, cyan, and black toner, respectively. The developing units and the toner supply paths have a common fundamental structure.

The clear developing unit 4*a* includes a developer container 4*a* for containing the developer including the clear toner, a developing sleeve 430*a* serving as a clear developer bearing member for bearing the clear developer, and an agitation and conveyance member 440*a* for agitating and conveying the developer contained in the developer container. A magnet having multiple magnetic poles is disposed in the developing sleeve 430*a* so as to allow the developing sleeve 430*a* to bear and convey the developer that has been magnetized. Refill developer is output from the supply pipe 400*a* and conveyed into the developer container 4*a* through a developer supply port 420*a*.

The color developing units 4*b* to 4*e* each include a developer container for containing color developer including toner in a corresponding color, a developing sleeve for bearing color developer serving as a color developer bearing member, and an agitation and conveyance member for agitating and conveying developer in the developer container. In this embodiment, a magnet having multiple magnetic poles is disposed in each developing sleeve so as to allow the development sleeve to bear and convey developer that has been magnetized. Refill developer is output from each of the supply pipes 400*b* to 400*e* and conveyed into the corresponding developer container through the corresponding developer supply port.

A weight 410 is disposed between the black developing unit 4*e* and the clear developing unit 4*a*. That is, the weight is disposed between the clear developing unit 4*a* and the developing unit that is farther from the clear developing unit 4*a* among the two developing units that are adjacent to the clear developing unit 4*a*.

The weight 410 and the five developing units are disposed at a pitch angle of substantially 60°. The positions are set such that the moment of inertia of the weight 410 around the center of a rotation shaft of the developing rotary (center of a rotary stay 45) is equal to the moment of inertia of each developing unit around the rotation shaft of the developing rotary. In this way, even if a developing unit is disposed in a biased position with respect to the rotation direction of the developing rotary, the moment around the rotation shaft of the developing rotary can be summed up to be substantially zero. That is, the sum of the moment around the rotation shaft of the developing rotary can be reduced by appropriately disposing the weight. Therefore, the developing rotary is prevented from rotating around the rotation shaft under its own weight when the developing rotary is supported on the rotation shaft.

The pitch angle used in this embodiment is described below.

Pitch angle is defined as the angle between lines connecting the center of the developing rotary (center of the rotary stay 45) to the centers of developing sleeves (or the center of the weight).

The centers of the developing sleeves and the weight are disposed every 60°, which is a quotient of 360° for the entire circumference divided by six, that is, the sum of the number of the five developing units and the weight.

The term "distance" used below refers to the distance between the developing sleeves measured in the circumferential direction of the developing rotary. To be precise, it refers to the length of an arc defined by the intersections of the double-dotted chain line, which is the outermost periphery of the sleeve, and the lines that connect the center of the rotary and the centers of the sleeves. The distance is proportional to the pitch angle.

With the above-described structure, the rotational balance of the developing rotary including the weight remains stable in any state, whereby image failure resulting from fluctuation of rotation of the developing rotary or other factors is prevented and excellent image formation is realized.

Since the developing units and the weight are disposed at the same pitch angle of 60°, the pitch angle between the clear developing unit 4*a* and the black developing unit 4*e* is 120°, which is double the pitch angle between the clear developing unit 4*a* and the yellow developing unit 4*b*. Therefore, the black toner that has been scattered from the black developing unit due to air movement, the air movement being caused by rotation of the photosensitive drum and blowing in a tangential direction of the photosensitive drum, is prevented from entering the clear developing unit, which is disposed in the scattering direction.

A term "positive direction" refers to a circumferential direction of the developing rotary in which the portion of the developing rotary facing the photosensitive drum (developing position) moves in the same direction as the movement of the circumference of the photosensitive drum. In other words, the positive direction refers to the direction in which the developing rotary rotates in the opposite direction to the rotation of the photosensitive drum. Suppose that one of the two developing units adjacent to the clear developing unit is in the developing position. In this embodiment, the clear developing unit is farther from the developing position when the clear developing unit is positioned in the positive direction relative to the developing position (and the black developing unit is in the developing position) than when the clear developing unit is positioned in the negative direction relative to the developing position (and the yellow developing unit is in the developing position). In terms of the positions of the developing units in the developing rotary, the distance between the clear developing unit and the black developing unit that is disposed adjacent to the clear developing unit in the negative direction is larger than the distance between the clear developing unit and the yellow developing unit that is disposed adjacent to the clear developing unit in the positive direction. Although the pitch angle between the clear development unit and the black development unit adjacent to the clear development unit is 120° and the pitch angle between the clear development unit and the yellow development unit adjacent to the clear development unit is 60° in the embodiment, the pitch angles are not limited thereto. That is, although the pitch angle P1 (=120°) between the clear development unit and the development unit adjacent to the clear development unit in the negative direction is double the pitch angle P1 (=60°) between the clear development unit and the development unit adjacent to the clear development unit in the positive direction in the embodiment, the pitch angles are not limited thereto. The ratio P2/P1 can be equal to or more than 1.2.

FIG. 2 shows a state in which clear toner, which is in a first color to be developed, is being developed. The developing rotary is rotating counterclockwise in the direction of an arrow in the figure. The photosensitive drum is rotating counterclockwise in the direction of an arrow in the figure.

Next, a toner supply section and a toner supply path to a developing unit are described in detail.

Figure 3:
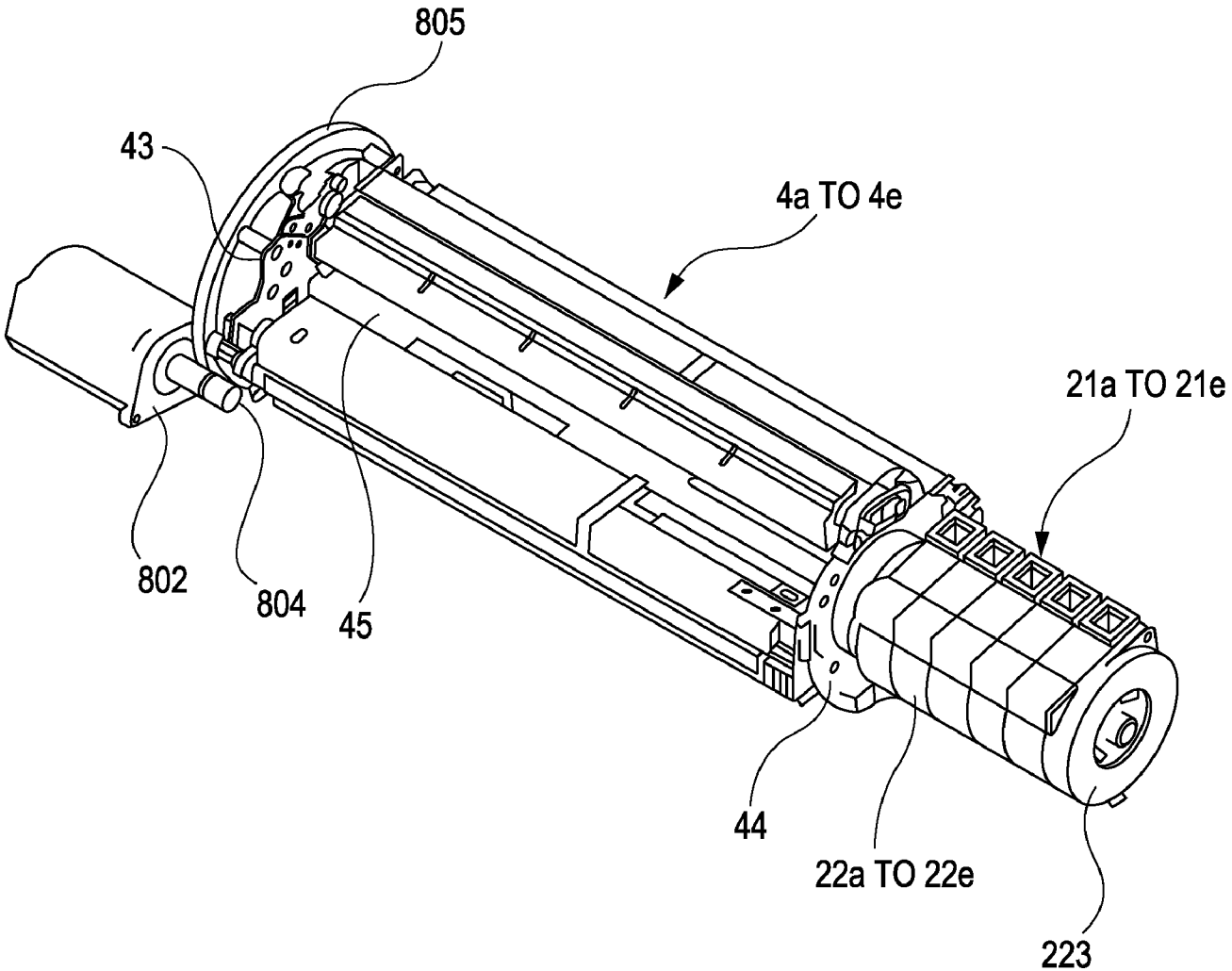
FIG. 3 is a perspective view of an area surrounding the developing rotary in the embodiment.
Figure 4:
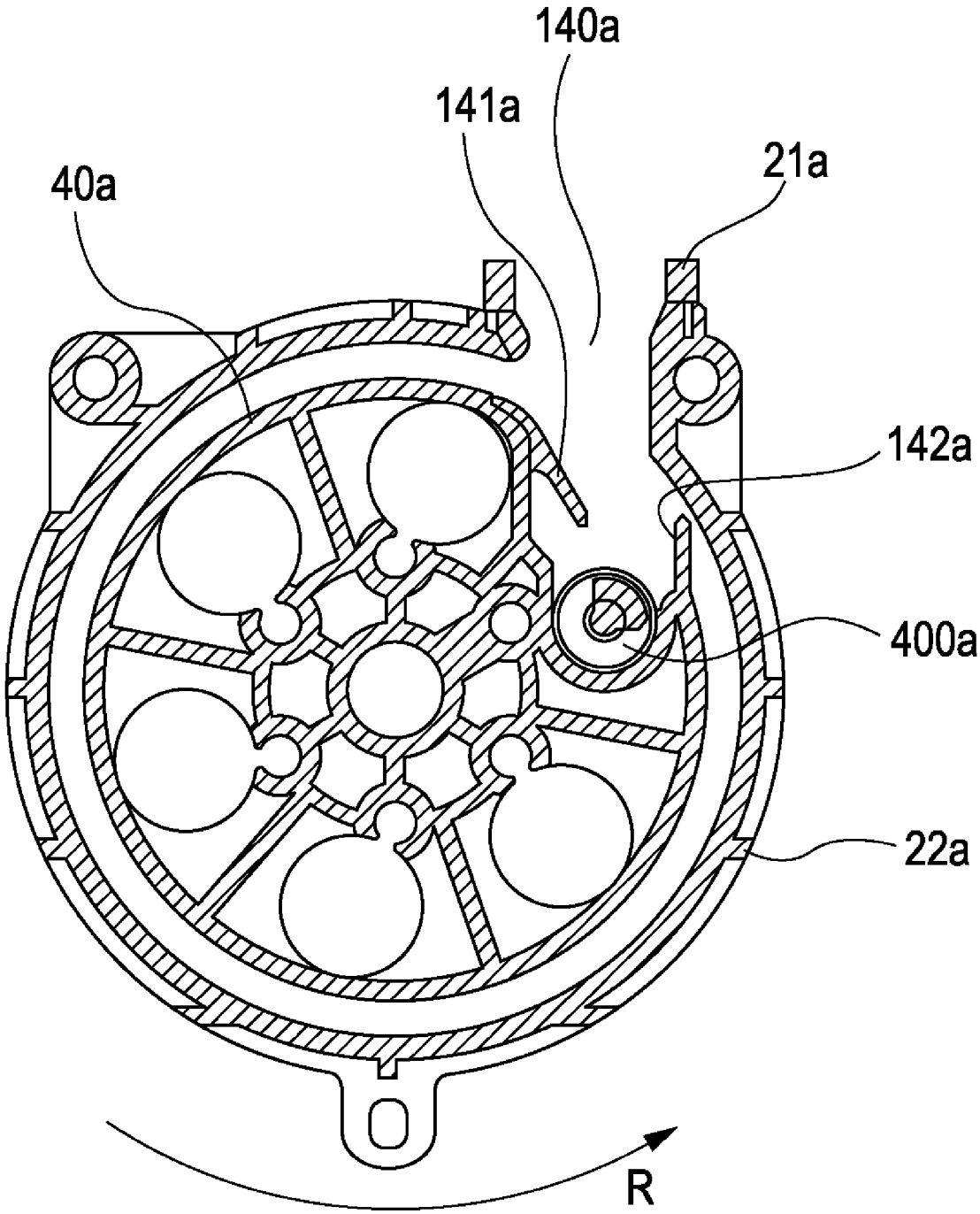
FIG. 4 is a sectional view of the developing rotary in the embodiment when the developing rotary is ready to receive toner.

FIG. 3 is an upper perspective view of the developing rotary, on which the developing units are mounted, and the toner supply port. FIG. 4 is a sectional view of a clear toner supply path when the clear developing unit 4*a* is in the developing position.

As shown in FIG. 3, the developing rotary includes a rear plate unit 43, a front plate unit 44, and a rotary stay 45. The developing rotary is rotatably supported by the main body of the full-color image forming apparatus via flanges (not shown) attached to the front and rear plate units.

Figure 7:
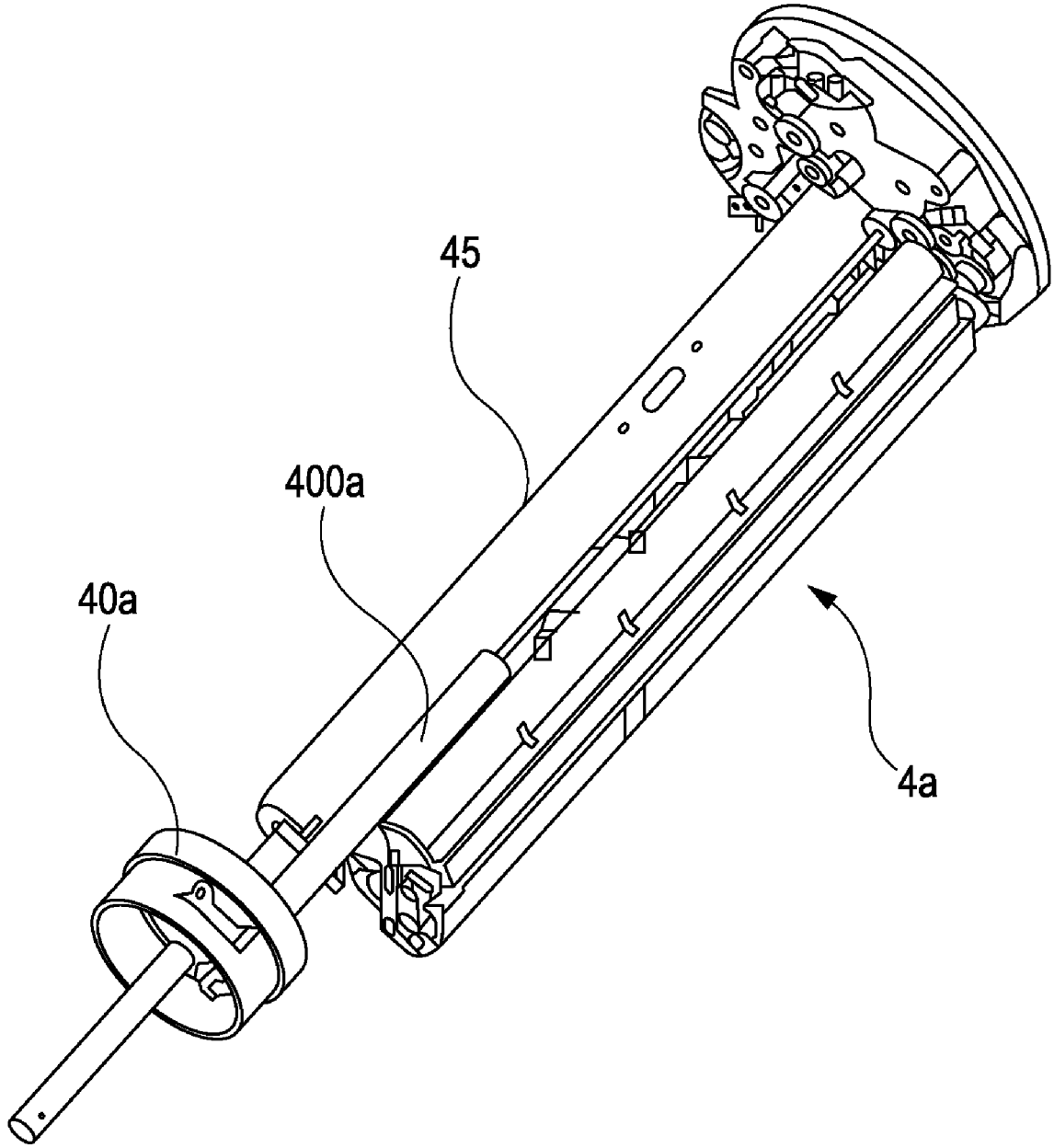
FIG. 7 is a perspective view of a toner supply path to the developing units in the embodiment.
Figure 8:
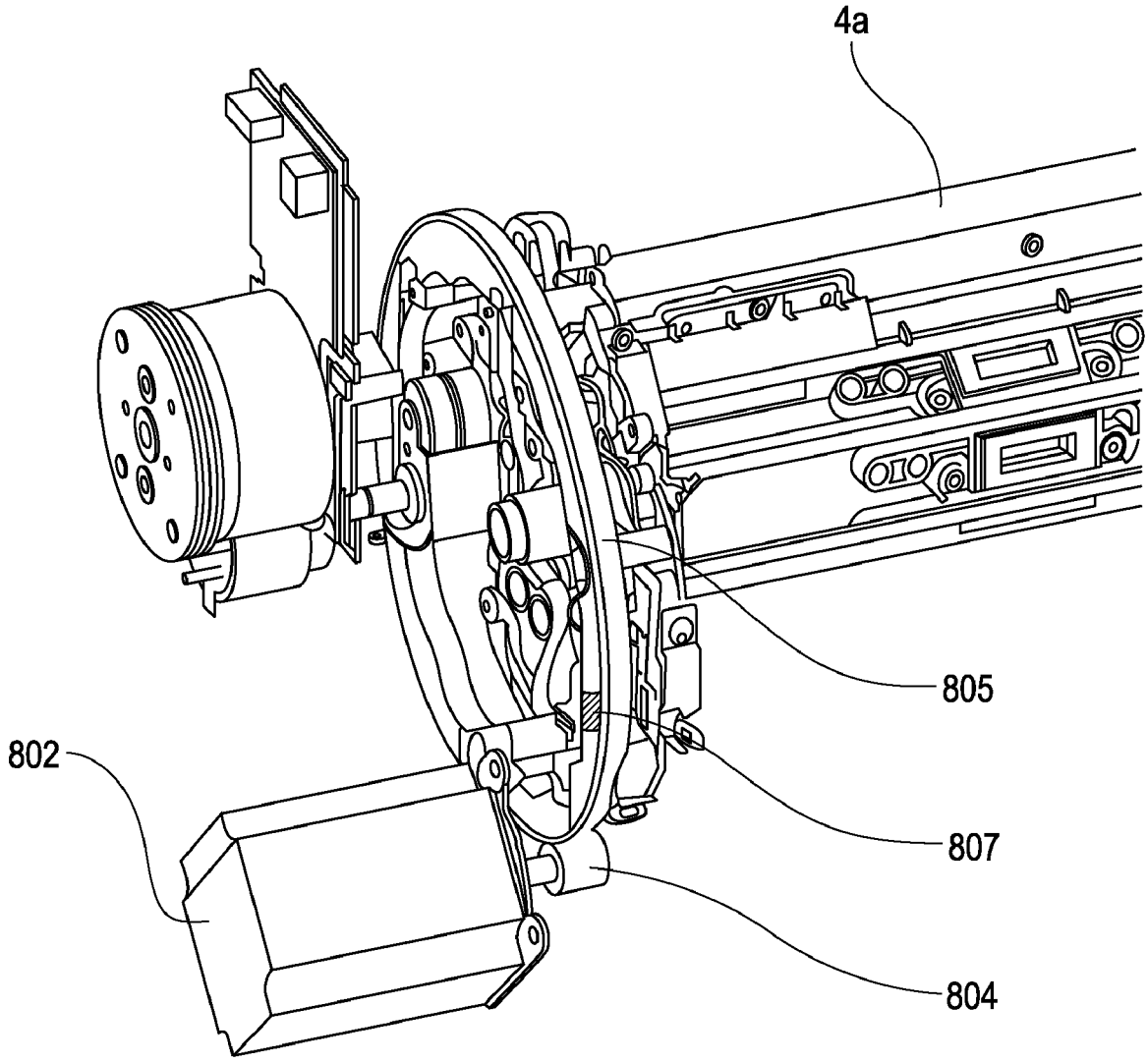
FIG. 8 is a perspective view showing a driving unit for the developing rotary in the embodiment.

FIG. 7 is a perspective view of the toner supply path to the developing unit. FIG. 8 shows a driving unit of the rotary. As shown in FIG. 8, rotation is transmitted from a rotary drive motor 802 mounted on a frame of the main body of the image forming apparatus to a rotary motor gear 804. Rotation is transmitted from the rotary motor gear 804 to a drive gear 805 so that switching between the developing units 4*a* to 4*e* is performed.

A stepping motor is used as the rotary drive motor 802, because switching between the developing units 4*a* to 4*e* has to be quickly performed in as little as about 200 ms, rotation has to be performed with a precise angle, and the developing units have to maintain its posture in their stopping positions.

Referring to FIG. 3, at the front of the developing rotary, fixed flanges 22*a* to 22*e* having toner receiving portions 21*a* to 21*e* are fixed to the frame of the main body. A flange cover 223 is disposed on an end of the fixed flanges 22*a* to 22*e*. These components constitute a toner receiving unit. Toner in respective colors is conveyed from toner cartridges (not shown) and received with the toner receiving portions 21*a* to 21*e*.

Referring to FIG. 4, when the clear developing unit 4*a* is in the developing position, toner is supplied through the path described below. The toner supply path includes the fixed flange 22*a* having the toner receiving portion 21*a*, a rotation drum 40*a* that rotates together with the developing rotary, and the supply pipe 400*a* including a screw for conveying toner to the developing unit 4*a*. The path is connected only when the corresponding developing unit is in the developing position. When the path is connected, toner that is received with the toner receiving portion 21*a* can be conveyed to the supply pipe 400*a*.

Movement of toner is described in detail.

Referring to FIG. 4, toner enters through an opening 140*a*, drops in the gravitational direction, and reaches the supply pipe 400*a*.

Only when the developing rotary is at the angle shown in FIG. 4, are the toner receiving portion 21*a* and the supply pipe 400*a* connected in the gravitational direction (vertical direction) so that the toner can be conveyed to the developing unit.

Since the rotation drum 40*a* rotates together with the rotary in the direction of arrow R in the figure, the rotation drum 40*a* has a toner backflow prevention wall 141*a* and a toner recovery wall 142*a* for scooping up toner. With this structure, all the supplied toner is conveyed to the developing unit.

A toner conveyance unit includes the rotation drum 40*a*, which is tubular, and the supply pipe 400*a* including a toner conveyance screw for conveying toner to the developing unit 4*a*.

As described above, toner is conveyed from the toner cartridge to the toner receiving portion shown in FIG. 3, and supplied to the rotation drum 40*a* as the toner drops into the drum when an opening of the drum becomes oriented upward by the rotation of the developing rotary.

As can be seen from FIG. 4, the supply pipe 400*a* is disposed inside the rotation drum 40*a* and rotated together with the developing unit so as to convey the dropping toner to the developing unit 4*a*.

The rotation drum 40*a* is configured such that the opening thereof is oriented upward when the developing unit 4*a* is in the developing position (image forming position) so that only the toner of a necessary color is supplied for development.

With the above-described positioning, developing units of maximal volumes can be disposed in the developing rotary having a limited space. Thus, degradation and density fluctuation of the developer can be prevented, and density fluctuation of the toner image can be prevented as much as possible, which greatly contributes to stabilization of the image.

Referring to FIG. 5, switching of the developing units, and operations from developing with black toner to developing with clear toner are described.

Figure 5A:
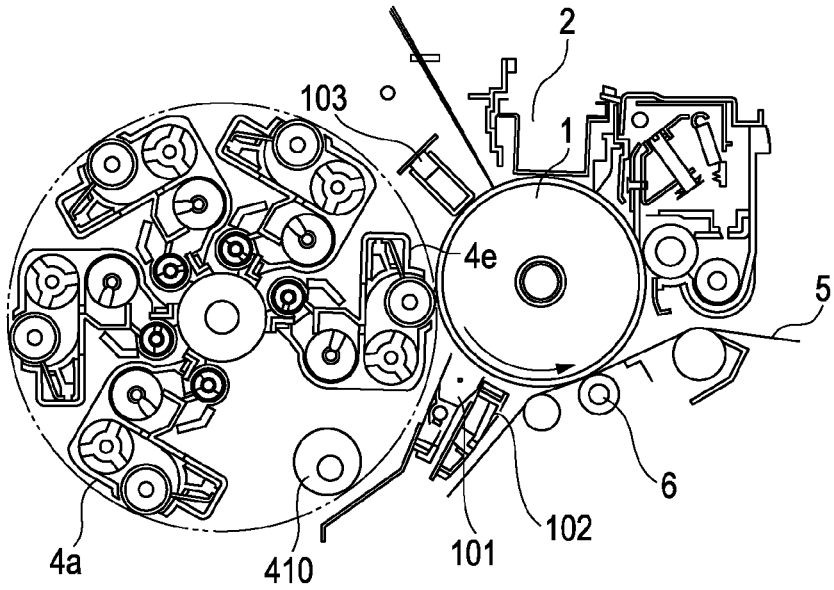
FIGS. 5A, 5B, and 5C are sectional views that show switching of developing units in the embodiment.

FIG. 5A shows a state in which developing with black toner is being performed.

An electric potential sensor 103 is disposed upstream of the portion of the photosensitive drum 1 facing the developing unit with respect to the rotation direction of the photosensitive drum 1. The electric potential sensor detects the electric potential of the surface of the photosensitive drum 1. A primary transfer charger 101 and an image density detection sensor 102 are disposed downstream of the portion of the photosensitive drum 1 facing the developing unit with respect to the rotation direction of the photosensitive drum 1. The primary transfer charger serves to provide a uniform electric potential to toner images before primary transfer. The image density detection sensor 102 serves to detect the actual density of the image that has been formed on the photosensitive drum with a specified density. The primary transfer charger 101, the image density detection sensor 102, and the electric potential sensor 103 contribute to stabilizing the image that is output from the image forming apparatus.

Since the sensors are disposed in an area surrounding the developing unit, it is difficult to provide a space for disposing an air duct for sucking toner that is scattered around the developing sleeve while development is being performed. Moreover, the area is close to an air flow for removing ozone generated by the primary charger and the air flow has priority. Therefore, a specific structure for recovering scattered toner is not disposed.

Even if such an air duct is disposed, the toner scattered around the developing sleeve might not be recovered due to limitation of space. On the contrary, the scattered toner might be collected and accumulated. A structure for recovering scattered toner is also not disposed for this reason.

The amount of scattered toner is reduced to an extremely small amount by improving magnetization of the cover of the developing unit and the developing sleeve. Therefore, the amount of scattered toner that reaches other developing units is negligibly small. Even if a developing unit (developing sleeve) for a different color is moved to a space in which scattered toner is suspended, this does not cause a big problem.

However, when clear toner is used as in the image forming apparatus of this embodiment, mixing of another color impairs clearness. In particular, when a clear toner image is formed on a white sheet, mixed toner is also developed on the white surface. If the mixing has occurred to a considerable degree, this is very conspicuous and unfavorable.

Therefore, measures against mixing of scattered toner are necessary where clear toner is concerned.

Hereinafter, a structure of the developing rotary and measures against mixing of scattered toner according to an embodiment of the present invention are described.

Figure 5B:
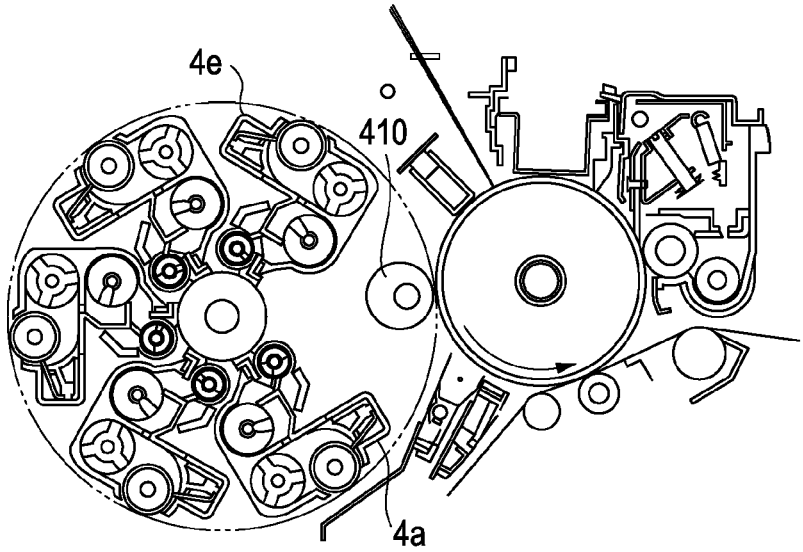
Figure 5C:
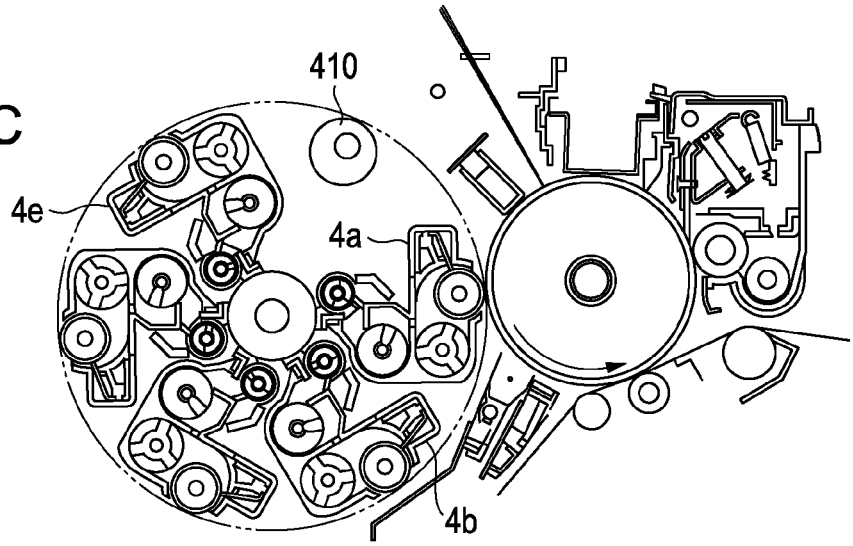

As shown in FIG. 5A, after developing with black toner has been finished as the final step of image formation, the developing rotary is rotated by an angle of 60° as in the case when the color is switched so that the weight 410 is moved to the developing position (FIG. 5B). Then, the clear developing unit 4*a* is moved again to the developing position so as to perform developing with clear toner, which is the toner in the first color, as a step for forming the next image (FIG. 5C). The time required for switching between the developing units in the rotary is the same for all the developing units, because the rotary drive motor 802 is controlled by the same control signal for performing switching (rotation) by 60°.

The time required for switching from the black developing unit to the clear developing unit is at least twice the time required for switching between color developing units for other combinations of colors.

In this embodiment, the rotary is stopped for about 100 ms after being moved so that vibration decays just after the rotary is switched. Since the switching time between developing units is 200 ms as stated above, it takes about 500 ms to switch from the black developing unit to the clear developing unit.

During the interval of 200 ms required for ordinary switching and the interval of 500 ms required for switching from the black developing unit to the clear developing unit, the toner scattered around the developing position can be reduced with an air flow nearby.

Figure 6:
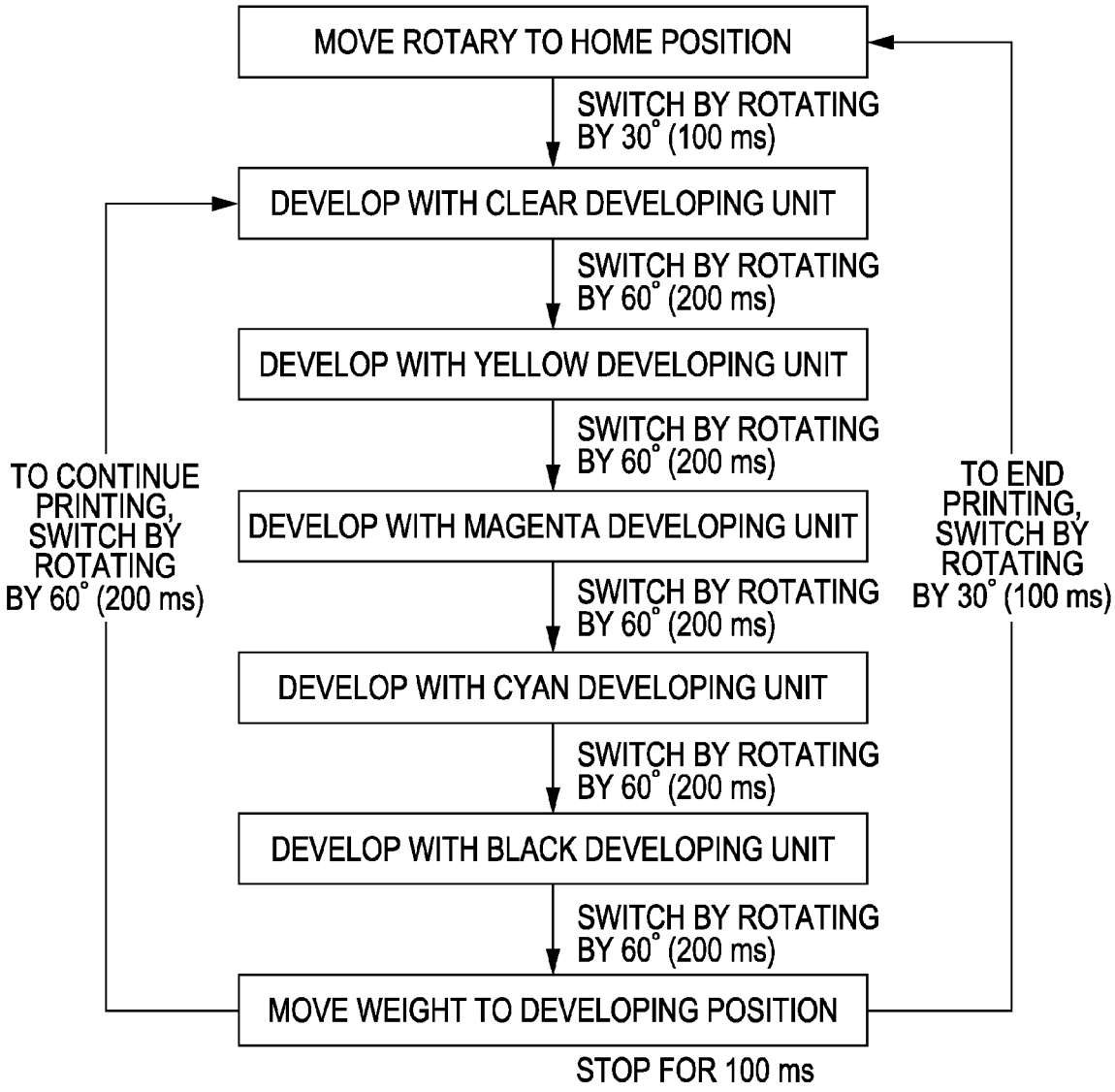
FIG. 6 is a flowchart of the rotation operation of the developing rotary in the embodiment.

FIG. 6 is a flowchart for the switching process of the rotary including the weight.

The standby position (datum point for starting rotation), or, in other words, the home position of the developing rotary of the developing units in the embodiment is described. The home position (datum point for starting rotation) refers to the position at which the rotary is stopped while image forming operation is not being performed. The controller 100 controls the rotary so that the rotary stops at the home position. By setting the home position, positions of the developing units can be tracked accurately relative to the home position as the datum point for rotation, and the development units can be moved accurately at any time to the developing position.

When the rotary is stopped at the home position, the clear developing unit 4*a* containing clear developer is upstream of the developing position by 30°. Since the developing rotary rotates in the counterclockwise direction (R), the clear developing unit 4*a* first develops an electrostatic image.

The angle is defined as the angle between the lines that connect the rotation center of the rotary and the rotation centers of the developing sleeves. When a developing unit is in the developing position (the position in which the developing sleeve of the developing unit faces the photosensitive drum), the rotation center of the rotary, the rotation center of the developing sleeve, and the rotation center of the photosensitive drum are on a straight line.

A developing rotary is moved to the home position as described below. While the rotary is rotating, a sensor (not shown), which is fixed to the main body of the image forming apparatus, detects a home position flag (position indicator) 807 attached to the drive gear 805 shown in FIG. 8. After the flag has been detected, the rotary is rotated by a specified angle with the rotary drive motor 802, and then the rotary is stopped.

This operation to move the rotary to the home position can be performed when image forming operation is finished, when image adjustment mode is finished, or when the image forming apparatus is switched on at the beginning of the day. The operation may be performed also when the apparatus is restarted after image forming operation has been interrupted due to paper jam or after the development units have been pulled out and reinstalled for maintenance or other purposes.

FIG. 6 shows a rotary switching operation when full-color image formation is performed with this embodiment. First, to start image formation, the clear developing unit is moved to the developing position so as to perform developing. Then, the yellow, magenta, and cyan developing units are successively moved to the developing position so as to perform developing. Lastly, the black developing unit is moved to the developing position so as to perform developing.

In this embodiment, clear toner is first developed so that clear toner is applied to the uppermost surface of a recording material when the toner is transferred onto the recording material. Usually, clear toner is placed on the uppermost surface of the recording material so as to change the gloss of an image. In this embodiment, black toner is last developed for the following reason. When toner is primarily transferred from the photosensitive drum onto the intermediate transfer member, the toner image that has been transferred onto the uppermost surface of the intermediate transfer member might be disturbed by retransfer. Since black toner is usually used for text or line drawings, such disturbance by retransfer has to be avoided especially for black images. Black toner is last developed for this reason. However, the order of developing is not limited to the order in this embodiment. Positioning of the developing units can be desirably changed as long as the advantages of the present invention can be gained.

Rotation operations between rotary home position and the clear developing unit and between the weight and the rotary home position are performed in 30° (100 ms) switching mode. Other rotation operations are performed in 60° (200 ms) switching mode. Switching operation of the rotary is performed, as necessary, as shown in the flowchart in FIG. 6.

Since the photosensitive drum rotates counterclockwise as shown in the figure, scattered toner generated in a usual developing process tends to flow in the direction of an arrow shown in the figure in correspondence with the movement of the surface of the photosensitive drum. Therefore, as can be seen by comparing FIG. 5A with FIG. 5C, as long as the black developing unit and the clear developing unit are separated by a certain distance, scattered toner that is generated when the black developing unit performs developing negligibly reaches the clear developing unit.

As heretofore described, the distance between the black developing unit and the clear developing unit is greater than the distance between other developing units. Moreover, the switching time between the black and clear developing units are longer than the switching time between other developing units. With this structure, scattered toner generated when black developing unit performs developing is reduced to a negligible amount or eliminated when the clear developing unit performs developing.

Scattered toner generated when the yellow developing unit, which is downstream of the clear developing unit, performs developing is very unlikely to be mixed with other color for the following reason. It is because, as describe above, toner tends to flow in the rotation direction of the photosensitive drum, and scattered toner tends to move upward rather than downward under its own weight. Moreover, since yellow is less conspicuous as compared with other colors, color mixing produces little ill effect.

Therefore, with the structure of the developing rotary and the developing unit of this embodiment, scattered toner in colors other than clear can be prevented from entering the clear developing unit disposed in the developing rotary. This structure also realizes stable rotation of the developing rotary, thereby suppressing image failure and enabling excellent image forming with clear toner.

In this embodiment, measures against mixing of scattered toner from adjacent developing units are described regarding clear toner, which is especially sensitive to color mixing. However, the present invention is not limited to this and, when clear toner is not used, can be applied to other developing unit that is most sensitive to color mixing. For example, the present invention can be applied to an image forming apparatus including a rotary member that holds development units containing white toner (toner in which white pigment is mixed) and toner of other colors. In this case, the developing unit (white developer bearing member) containing white developer including white toner corresponds to the clear developing unit of this embodiment. Moreover, the present invention can be applied to an image forming apparatus including a rotary member that holds developing units containing developer with the same hue and different brightnesses. In this case, a developing unit for developer with a high brightness may correspond to the clear developing unit in this embodiment, because a developing unit containing a high-brightness (light) toner (a developing unit for high-brightness developer) is sensitive to color mixing as compared with developing units for other colors.

According to exemplary embodiments of the invention, in an image forming apparatus including a rotary member that holds developing units including a clear developing unit or a white developing unit, scattered developer can be prevented from entering the clear developing unit or the white developing unit from adjacent developing units with a simple structure.

Moreover, according to exemplary embodiments of the invention, in an image forming apparatus including a rotary member that holds developing units containing developer with different brightnesses, scattered developer can be prevented from entering a developing unit for a color with the same hue and a higher brightness from the adjacent developing units with a simple structure.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-084107 filed Mar. 27, 2008, which is hereby incorporated by reference herein in its entirety.

What is claimed is:

1. An image forming apparatus comprising:

an image bearing member on which an electrostatic image is to be formed;

a predetermined number of developing units including a first developing unit configured to contain a first color toner, a second developing unit configured to contain a second color toner, lightness of which is lower than that of the first color toner, and a clear developing unit configured to contain a clear toner;

a mechanism configured to hold the predetermined number of developing units and to rotate the developing units held around a rotation shaft so that one of the developing units is opposed to the image bearing member so as to develop the electrostatic image formed on the image bearing member, wherein the clear developing unit held by the mechanism is disposed adjacent to the first developing unit and the second developing unit, wherein a pitch angle between the clear developing unit and the second developing unit is larger than a pitch angle between the clear developing unit and the first developing unit; and a balancer held between the clear developing unit and the second developing unit and configured to reduce the sum of moments of force around the rotation shaft.

2. The image forming apparatus according to claim 1, wherein when a rotation direction of the mechanism opposite to a rotation direction of the image bearing member is a positive direction, the clear developing unit is adjacent to the first developing unit at a position in a negative direction with respect to the developing position when the first developing unit is at the developing position, and the clear developing unit is adjacent to the second developing unit at a position in the positive direction with respect to the developing position when the second developing unit is at the developing position.

3. The image forming apparatus according to claim 1, wherein the first color toner is yellow toner and the second color toner is black toner.

* * * * *